United States Patent [19]

Sadamatsu et al.

[11] 4,245,022

[45] Jan. 13, 1981

[54] DRY ELECTROPHOTOGRAPHIC DEVELOPERS

[75] Inventors: Shigeru Sadamatsu; Masakatsu Kimura, both of Minami-ashigara, Japan

[73] Assignee: Fuji Xerox Co., Ltd., Tokyo, Japan

[21] Appl. No.: 731,482

[22] Filed: Oct. 12, 1976

[30] Foreign Application Priority Data

Oct. 13, 1975 [JP] Japan ..... 50-122443

[51] Int. Cl.[2] ..... G03G 9/10

[52] U.S. Cl. ..... 430/110; 430/111

[58] Field of Search ..... 252/62.1 P, 62.1 R; 430/110, 111

[56] References Cited

U.S. PATENT DOCUMENTS

| | | | |
|---|---|---|---|
| 2,494,827 | 1/1950 | Munter | 252/116 |
| 3,520,818 | 7/1970 | Cambre | 252/113 |
| 3,533,835 | 10/1970 | Hagenbach et al. | 252/62.1 P |
| 3,632,337 | 1/1972 | Crooks | 252/62.1 P |
| 3,743,682 | 7/1973 | Crooks | 252/62.1 P |
| 3,900,588 | 8/1975 | Fisher | 252/62.1 P |
| 3,983,045 | 9/1976 | Jugle et al. | 252/62.1 P |

OTHER PUBLICATIONS

*Hackh's Chemical Dictionary, 1969, p. 134.*

*Primary Examiner*—Bruce H. Hess

*Attorney, Agent, or Firm*—Sughrue, Rothwell, Mion, Zinn and Macpeak

[57] ABSTRACT

A xerographic developer including 2 to 10% by weight of abrasive particles having a diameter of 100 to 800μ, exhibiting no electrophotographic developing effect, substantially no frictional charging, having a low toner retention capacity, and as much fluidity as the carriers employed. Such particles improve the charging properties of the carriers, prevent the attachment or adherence of the toner to the machine parts, improve the surface potential of the light-sensitive member, and lessen or eliminate the deterioration of the light-sensitive member due to the "deletion phenomenon".

2 Claims, No Drawings

DRY ELECTROPHOTOGRAPHIC DEVELOPERS

BACKGROUND OF THE INVENTION

The present invention is concerned with a developer for use in dry electrophotography.

The electrophotographic method generally known as xerography utilizes a light-sensitive member in the form of a drum, which is prepared by vapor-depositing a photo-conductive material such as amorphous selenium or a selenium based alloy on an electrically conductive support comprised of copper, aluminum, or the like. The light-sensitive member is charged and exposed to light to form an electrostatic latent image on the surface thereof, which is then developed by the cascade method, the magnetic brush method, the fur brush method, or the like to obtain a visible toner image. The visible image is transferred to a suitable support by the application of an auxiliary electric charge or by corona discharge, and at the same time any untransferred toner remaining on the surface of the light-sensitive member is removed by a cleaning treatment. The light-sensitive member is repeatedly used in the manner described.

According to the cascade developing method, the developer is scooped from a reservoir by buckets provided on an endless conveyer and is dropped onto a light-sensitive member, on which an electrostatic image has been formed, to thereby develop the electrostatic image. Thereafter the developer is removed from the light-sensitive member and returned to the reservoir.

In the magnetic brush method developers containing toners and magnetic carriers are attracted by a magnet in the form of a brush. The light-sensitive member on which an electrostatic image has been formed is rubbed by the brush, whereby the developers are attracted onto the electrostatic image owing to its electrostatic attracting force, thereby developing the electrostatic image.

Although the developers used in these methods are durable for many thousands of repeated uses, the carriers contained in the developers deteriorate owing to mechanical collisions between carrier particles, frictional wear and erosion of the carrier surface, toner adherence to the roughened carrier surfaces, etc., when used for a long period of time. Such deterioration of the carrier changes the friction charging characteristics thereof, i.e. the "tribo electric property", and adversely influences the quality of the copy obtained, thus making it necessary to change the carrier frequently, and thereby incurring much labor and cost.

In continuously supplying conventional developers to a copying machine, contact impulse is caused with the developers remaining in the copying machine, particularly among toners attached to the surface of carriers owing to friction charging. The toners are influenced by friction charging, which is not desired from the standpoint of forming an image. Also, the toners attach to the inside of the copying machine and much labor is needed for sweeping away the toner particles.

Moreover, conventional light-sensitive members are subject to the so-called deletion phenomenon due to external causes at the stage of charging. Deletion phenomena refers to toner filming on the surface of the photo-sensitive materials, and the attachment of air borne impurities and contaminants to the surface. Thus, images obtained are locally blurred. When such deletion occurs, the light-sensitive member is cleaned with an organic solvent, such as isopropyl alcohol, or the like. However, it is difficult to completely solve the problem by cleaning. Consequently, it is conventional to change the light-sensitive member, which is very expensive.

With conventional light-sensitive members the residual developer is removed with a brush made of a synthetic fiber such as nylon, cellulose, or the like, or wool, or with a blade made or urethane rubber. However, since it is difficult to completely remove the developer on the light-sensitive member by these methods, the developer remaining on the light-sensitive member after cleaning causes the copier to make dirty copies or gives rise to the deletion phenomenon, thereby deteriorating the photo-conductivity and charging properties of the light-sensitive member. Therefore, the surface of the light-sensitive member has hitherto been ground with an abrasive solution prepared by dispersing an abrasive such as strontium sulfate, barium sulfate, or the like in an organic solvent to thereby remove the deposited or attached developer. However, there is a fear that use of the above abrasive and organic solvent may be detrimental to the operator's health.

SUMMARY OF THE INVENTION

It has been found that the above described conventional defects can be removed and the objects of the present invention can be attained by incorporating into a developer comprised of toners and carriers, a suitable amount of materials having no electrophotographic developing effect. For example, the materials should cause substantially no charging due to friction with the toners and carriers, should have a toner retention ability of about 1/10 or less of conventional dry electrophotographic carriers which have the capability to retain toners as much as 0.1 to 5% owing to charging due to friction, should have as much fluidity as the carriers, and should also be abrasive. Examples include silica, fused alumina, silicone carbide, boron carbide, other carbides, nitrides, or those particles having raised or roughened surface portions.

When one or more of the above materials are incorporated into the developer, the deletion phenomenon does not take place at all even though copying is effected as often as 5,000 to 20,000 times whereas when 5,000 to 20,000 sheets are copied with conventional developers a significant degree of deletion occurs, particularly with selenium-arsenic based light-sensitive members. Moreover, the phenomenon whereby the toners attach to the inside of the machine owing to contact impulse among carriers in the developing machine does not occur, and even if it has previously occurred in large amounts the toners are rapidly peeled and removed when the materials of the invention are added, and they do not build up deposits.

On the other hand, the incorporation of the above materials into the developer prevents the filming phenomenon caused by some developer remaining even after the light-sensitive member is cleaned, i.e. the attachment of a thin film of remaining toner to the surface of the photo-sensitive material or to the carrier. Therefore, the fear of the photoconductivity and charging properties being reduced can be eliminated without applying any abrasion, and thus it is now possible to eliminate the secondary hindrance due to the abrasive and organic solvent and the inconvenience of reducing the shelf life of the light-sensitive member itself.

DETAILED DESCRIPTION OF THE INVENTION

Natural materials which can be used in accordance with the invention include powders of corundum, emery, garnet, tripoli, diatomaceous earth, spinel, lime, flint shot and the like, and synthetic materials which can be used include powders of alumina, iron oxide, chromium oxide, cerium oxide, calcined dolomite, and the like.

The incorporation of the above materials into the developer in an amount of 2 to 10% by weight materially removes the above described defects attendant with the prior art.

In developers for electrophotography, toners and carriers attract each other owing to friction charging, thereby producing a developing effect. When the above materials are incorporated into the developer, however, the above effect is completely eliminated. Also, where some friction charging has occurred, the background and contrast increases markedly after the use of the invention as compared with the state where the carriers have deteriorated, whereby good images can once more be obtained.

For this reason, the friction charging characteristics of materials incorporated into the developer are preferably low, whereby the materials carry substantially no toner particles on their surfaces during development.

Examples according to the invention are shown below.

EXAMPLE 1

With a selenium alloy light-sensitive member (arsenic 35% by weight) and a developer containing silicon sand (Ottawa Sand) of 500 to 590μ diameter in an amount of 2.5% by weight based on the weight of the developer, 20,000 sheet continuous copying was conducted, and the charging properties of the carrier, the contamination of the inside of the developing machine, the surface potential of the light-sensitive member, and the deletion of the light-sensitive member were then examined.

Charging Properties of the Carrier

| | |
|---|---|
| Comparison Carrier | 11.0 μc/g |
| This invention | 13.5 μc/g |

Contamination of the Inside of the Developing Machine

| | |
|---|---|
| Comparison Developer | Solid Attachment |
| This Invention | No Attachment |

Surface Potential of the Light-sensitive Member

| | |
|---|---|
| Comparison Developer | 700 V |
| This Invention | 790 V |

During this continuous copying, no deletion of the light-sensitive member occurred, and the surface of the light-sensitive member remained clean.

EXAMPLE 2

With a developer to which Ottawa Sand with raised portions of 500 to 800μ diameter (rougher than the sand in Example 1) was added in an amount of 5.0% by weight based on the weight of the developer, and a light-sensitive member on which deletion has occurred, 3,000 sheet continuous copying was conducted. At the end of the copying the deletion areas had completely peeled off and the light-sensitive member had recovered or been restored to the extent that sharp copies could be obtained. The initial surface potential at the areas where deletion had occurred was 200 V, and when the test was finished such areas had potentials of 750 V.

EXAMPLE 3

A developer to which Sakrundum #54 (a mixture of fused alumina and $Al_2O_3$ produced by Nippon Carlit Co., Ltd.) particles of 297 to 420μ diameter was added in an amount of 3.0% by weight based on the weight of the developer was tested in the same manner as in Example 1, and results similar to those of Example 1 were obtained. In respect of the amount of toner attached to the surface of the carriers, good results were obtaned. attached to the surface of the carriers, good results were obtained.

The amount of charging between the Sakrundum #54 and the toner was −0.56 μc/g.

EXAMPLE 4

With a developer to which Morundum #46 ($Al_2O_3$ particles produced by Showa Denko K.K.) having a diameter of 420 to 500μ was added in an amount of 7.0% by weight based on the weight of the developer, and a light-sensitive member on which toner-filming had occurred and with which no sharp copies could be obtained, 3,000 sheet continuous copying was conducted. The last copies at the end of the run had good image sharpness and high picture density or contrast.

The surface potential of the light-sensitive member increased by 80 V.

What is claimed is:

1. In a dry electrophotographic developer including a toner and a carrier, the improvement consisting essentially of:

the addition thereto of 2 to 10% by weight of abrasive particles having a diameter of 100 to 800μ, which particles are not capable of any substantial degree of frictional charging and thus do not attract toner and carry same on their surfaces to any significant degree and wherein said particles have a toner retention capacity of one-tenth or less than that of the carrier, have the same degree of fluidity as the carrier, and exhibit no electrophotographic developing effect.

2. A developer as defined in claim 1, wherein said particles are selected from the group consisting of silica, fused alumina, silicon carbide, boron carbide, corundum, emery, garnet, tripoli, diatomaceous earth, spinel, lime, flint shot, iron oxide, chromium oxide, cerium oxide, calcined dolomite, and nitrides.

* * * * *